US005581988A

United States Patent [19]

Fink et al.

[11] Patent Number: 5,581,988

[45] Date of Patent: Dec. 10, 1996

[54] YARN BRAKE ESPECIALLY FOR TWO-FOR-ONE TWISTING SPINDLES

[75] Inventors: Heinz Fink, Krefeld; Johannes Frentzel-Beyme, Mönchengladbach, both of Germany

[73] Assignee: Palitex Project-Company GmbH, Krefeld, Germany

[21] Appl. No.: 360,993

[22] Filed: Dec. 20, 1994

[30] Foreign Application Priority Data

Dec. 20, 1993 [DE] Germany ..... 43 43 458.4

[51] Int. Cl.[6] ..... D01H 1/10; D01H 7/86

[52] U.S. Cl. ..... 57/58.86; 57/113; 57/279

[58] Field of Search ..... 57/279, 58.86, 57/113

[56] References Cited

U.S. PATENT DOCUMENTS

| | | | |
|---|---|---|---|
| 4,391,090 | 7/1983 | Charbonier | 57/58.86 X |
| 4,468,920 | 9/1984 | Lorenz | 57/279 |
| 4,782,653 | 11/1988 | Yanobu | 57/279 |

FOREIGN PATENT DOCUMENTS

| | | | |
|---|---|---|---|
| 1497288 | 10/1967 | France | 57/58.86 |
| 1510860 | 6/1972 | Germany . | |
| 3000443 | 7/1981 | Germany | 57/58.86 |
| 3134763 | 6/1983 | Germany . | |
| 589300 | 1/1978 | U.S.S.R. . | |

*Primary Examiner*—William Stryjewski

*Attorney, Agent, or Firm*—Robert W. Becker & Associates

[57] ABSTRACT

A yarn brake has a tubular brake housing with an upper and a lower end. A lower brake ring is connected to the lower end of the brake housing. A brake ring carrier is positioned in the housing at a distance above the lower brake ring and has a central axis about which it is rotatable. The brake ring carrier is axially slidable within the brake housing. A spring is positioned in the brake housing between the upper end and the brake ring carrier for biasing the brake ring carrier in a downward direction. An upper brake ring is connected to the brake ring carrier so as to face the lower brake ring. A brake cartridge rests between the upper and the lower brake rings. An abutment is connected to the brake housing and extends radially into the brake housing. The brake ring carrier has a plurality of support shoulders distributed over the periphery of the brake ring whereby these support shoulders are axially spaced relative to one another. Depending on a rotational position of the brake ring carrier one of the support shoulder is supported on the abutment. The abutment is arrestable at various axial positions in the brake housing.

4 Claims, 2 Drawing Sheets

YARN BRAKE ESPECIALLY FOR TWO-FOR-ONE TWISTING SPINDLES

BACKGROUND OF THE INVENTION

The present invention relates to a yarn brake, especially for two-for-one twisting spindles, having a tubular brake housing into which an abutment extends in the radially inward direction and in which a brake cartridge in the form of a capsule rests at a lower brake ring and at an upper brake ring. The upper brake ring is positioned in a spring-loaded brake ring carrier that is rotatable about its axis and is axially displacable. The brake ring carrier has distributed about its circumference a plurality of support shoulders that have an axial spacing relative to one another whereby one of the support shoulders, depending on the rotational position of the brake ring carrier, rests on the abutment.

Especially in connection with two-for-one twisting spindles yarn brakes are known which are comprised of a brake housing through which the yarn is guided in the axial direction. The inlet and outlet openings are formed by brake rings with conical brake surfaces. These brake rings, in general, are made of a material with high wear resistance. Between the brake rings at the inlet and the outlet side, the actual brake body extends which is, in general, a brake cartridge made of two cylindrical sleeves that are telescopically inserted into one another and have semi-spherical, respectively, cup-shaped ends. The sleeves enclose a pressure spring that upon insertion of the brake cartridge into the brake housing is tensioned by compressing the two sleeves so that the semi-spherical ends of the sleeves exert that braking pressure onto the brake rings that is required for the yarn guided through the yarn brake. Depending on the magnitude of the required braking pressure, stronger or weaker springs are inserted into the brake cartridge.

With a yarn brake disclosed in German Patent 15 10 860 it is possible, by changing rotational position of the brake ring carriers, to bring into contact a different support shoulder on the abutment so that it is possible to change the braking force without exchanging the brake cartridge.

German Patent 31 34 763 discloses a yarn brake with a capsule-shaped brake cartridge that is clamped between the lower and upper brake rings. A pin which is radially adjustable against the force of a spring is supported within the upper brake ring. The adjustable pin can be inserted into one of a plurality of axially spaced bores of the brake housing in order to change the braking force of the yarn brake. This yarn brake allows, as a function of the number of individual bores and the axial distance of these bores relative to one another, to provide for certain braking force levels comparable to the solution disclosed in German Patent 15 10 860.

Such yarn brakes, which are also called capsule yarn brakes, are limited with respect to their radial extension, especially when they are to be inserted into the hollow shaft of a two-for-one twisting spindle. This is partially due to the very small inner diameters of the spool carrier sleeves. As a consequence of these small dimensions, the periphery of the upper brake ring carrier can be provided only with a limited number of support shoulders, especially when in the form of axial slots. In practice, the upper brake ring carrier is generally provided with four to six support shoulders distributed over the circumference so that accordingly there is also only a limited number of adjustment options for the braking force. It is not possible to vary the adjustment range by providing a greater difference between the axial slots (groove depth) because then the individual steps are spaced too far from one another.

It is therefore an object of the present invention to improve a yarn brake of the aforementioned kind such that the number of adjustment possibilities for the braking force is increased.

SUMMARY OF THE INVENTION

The yarn brake according to the present invention is primarily characterized by:

A tubular brake housing with an upper and a lower end;

A lower brake ring connected to the lower end of the brake housing;

A brake ring carrier positioned in the housing at a distance above the lower brake ring;

The brake ring carrier having a central axis about which the brake ring carrier is rotatable;

The brake ring carrier is axially slidable within the brake housing;

A spring positioned in the brake housing between the upper end and the brake ring carrier for biasing the brake ring carrier in a downward direction;

An upper brake ring connected to the brake ring carrier so as to face the lower brake ring;

A brake cartridge resting between the upper and the lower brake rings;

An abutment connected to the brake housing and extending radially into the brake housing;

The brake ring carrier having a plurality of support shoulders distributed over a periphery of the brake ring carrier, the support shoulders being axially spaced relative to one another, wherein, depending on a rotational position of the brake ring carrier, one of the support shoulders is supported on the abutment; and The abutment arrestable at various positions in the axial direction of the brake housing.

Preferably, the abutment is comprised of a cam and a rotary pin, whereby the cam is eccentrically connected to the rotary pin. The rotary pin is inserted into the tubular wall of the brake housing. The rotary pin is actuatable from the exterior of the brake housing.

Preferably, the rotary pin has a circular cross-section and the tubular wall of the rotary housing has a radial bore in which the rotary pin is rotatably supported.

Advantageously, the abutment has a circular cross-section. Other embodiments are possible in which the abutment has the cross-section of a regular polygon.

Expediently, the brake housing has a plurality of insertion openings distributed over the circumference of the brake housing and spaced from one another in the axial direction of the brake housing for receiving the abutment. Preferably, the abutment is pin shaped.

According to the present invention, the abutment within the brake housing is arrestable at various positions in the axial direction. Depending on the selected axial position of the abutment, it is possible, on the one hand, to increase the maximum range of braking force adjustment, while, on the other hand, it is also possible to achieve a fine adjustment within the entire braking force range in smaller steps.

According to a preferred embodiment of the invention, it is suggested that the abutment is in the form of a cam which is connected eccentrically to a rotary pin inserted into the tubular wall of the brake housing and actuatable from the exterior of the brake housing. By rotating the rotary pin and thus the abutment, i.e., the cam by 180° the maximum braking force range is determined, while a rotation by only 90° provides for increased possibilities for a selection of fine adjustments of the yarn brake.

With special geometric forms of the cam cross-section, for example, a circular shape, elliptical or oval shape, and also with different positions which the eccentric cam can have relative to the axis of rotation of the rotary pin, various adjustment possibilities for the braking force can be provided.

BRIEF DESCRIPTION OF THE DRAWINGS

The object and advantages of the present invention will appear more clearly from the following specification in conjunction with the accompanying/drawings, in which.

DESCRIPTION OF PREFERRED EMBODIMENTS

The present invention will now be described in detail with the aid of several specific embodiments utilizing FIGS. 1 through 5.

Figure 1:
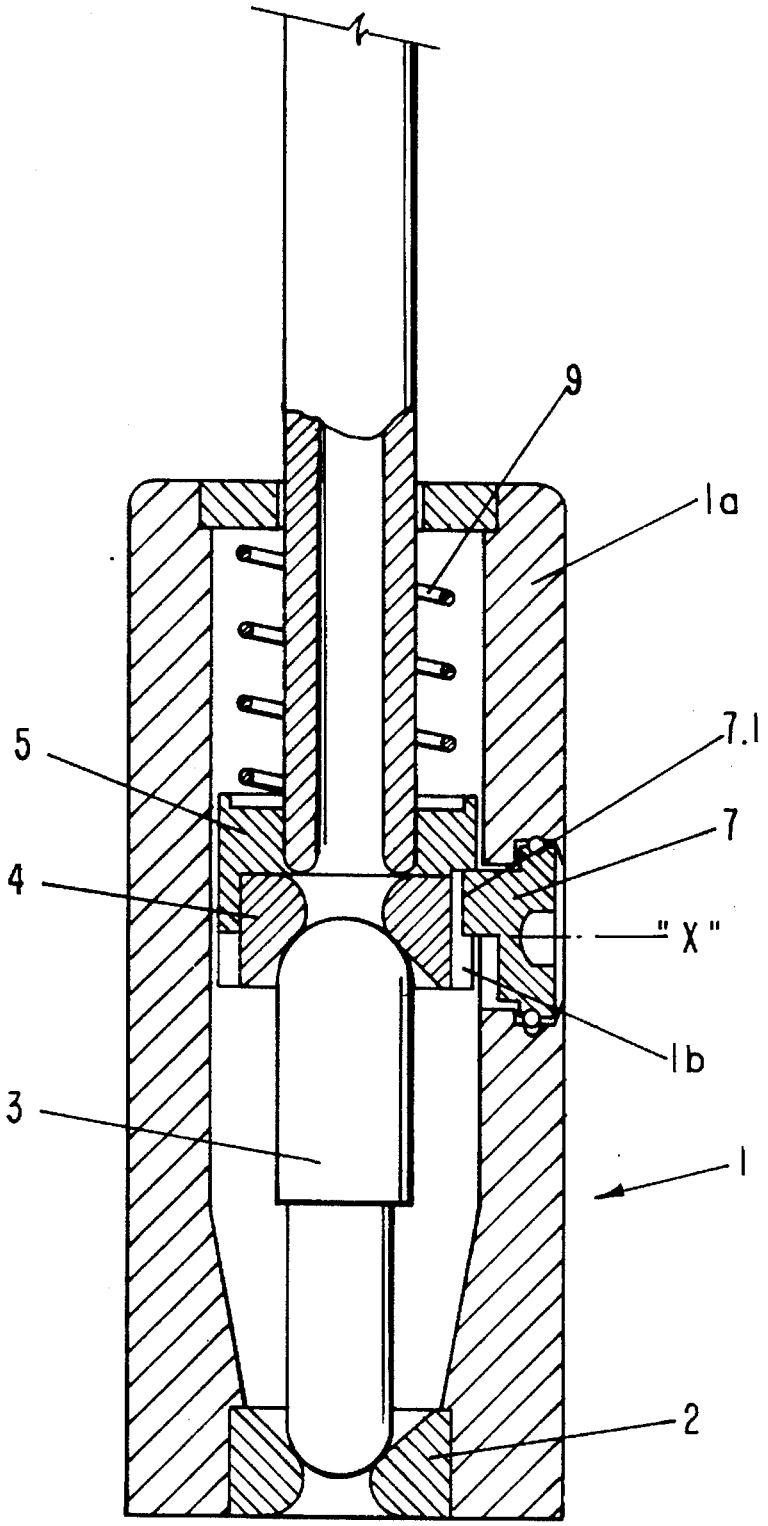
FIG. 1 shows in section the brake housing with a brake ring carrier at the inlet side of the brake which is adjustable with respect to its insertion depth.
Figure 2:
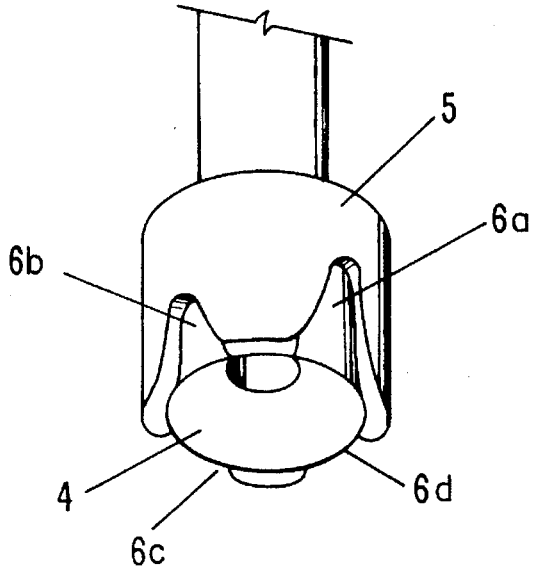
FIG. 2 shows in a perspective view the axially adjustable brake ring carrier with its support shoulders.

According to FIG. 1 the adjustable yarn brake to be used especially for insertion into the hollow spindle shaft of two-for-one twisting spindles, is comprised of a cylindrical brake housing 1 with a lower brake ring 2 at the yarn exit. The brake cartridge 3 is supported on the lower brake ring 2 and can be telescopically compressed against the force of a spring. The upper brake ring 4 rests on the upper end of the brake cartridge 3 which upper end is also cupped-shaped. The upper brake ring 4 is inserted into a brake ring carrier 5 biased by spring 9 in the downward direction. Radially outwardly relative to the upper brake ring 4, the brake ring carrier 5 is provided with support shoulders distributed over the circumference, for example, four such support shoulders (as shown in FIG. 2). They are formed by cutouts *6a, 6b, 6c,* and *6d* of various depth which, for example, can conically taper toward their bottom.

Figure 3:
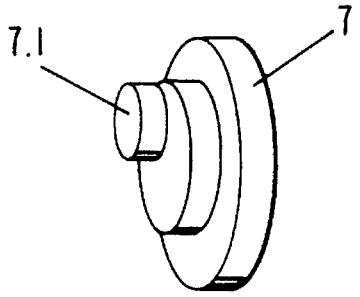
FIG. 3 shows a perspective view of the inventive abutment in the form of an eccentrically positioned cam connected to a rotary pin.
Figure 4:
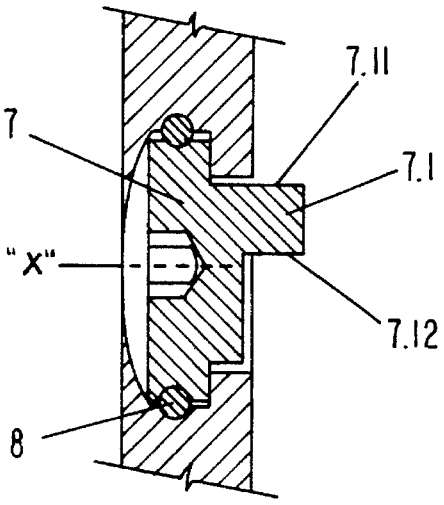
FIGS. 4 and 5 show in a schematic representation the abutment in its two extreme positions.
Figure 5:
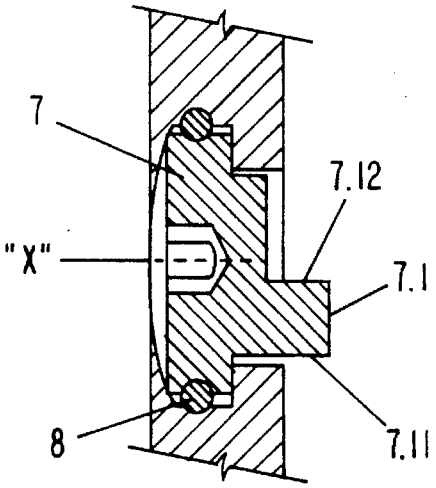

An abutment comprised of a cam 7.1 and a rotary pin 7 with the cam 7.1, according to FIG. 3, eccentrically connected to the rotary pin 7 that is inserted into the tubular wall of the brake housing 1 and actuatable from the exterior, projects into the interior of the brake housing 1. According to FIG. 3, the cam 7.1 has a circular cross-section or a cross-section of a regular polygon. The FIGS. 4 and 5 show the two extreme positions of the cam 7.1 that can be attained by rotating the rotary pin 7 by 180°. Depending on the rotational position of the rotary pin 7 and thus of the cam 7.1, either the support surface 7.11 that has the greatest distance from the axis of rotation X of the rotary pin 7 or the support surface 7.12 that has the smallest distance to the axis X of rotary pin 7 forms the actual support surface for the brake ring carrier 5. Accordingly, as a function of the rotational position of the brake ring carrier 5, the cam 7.1 enters either with its support surface 7.11 or its support surface 7.12 one of the cutouts *6a* to *6d*.

The rotary pin 7 is secured within a radial bore **1*b* of the tubular wall 1*a* of the brake housing 1 with a spring ring 8**.

According to another embodiment (not illustrated) of the present invention it is suggested to provide within the brake housing 1, distributed over its circumference, a plurality of insertion openings spaced in the axial direction from one another in order to provide receiving means for a pin-shaped support abutment that can be inserted into one of these insertion openings so as to extend into the interior of the brake housing.

The present invention is, of course, in no way restricted to the specific disclosure of the specification and drawings, but also encompasses any modifications within the scope of the appended claims.

What we claim is:

1. A yarn brake comprising:

a tubular brake housing with an upper and a lower end;

a lower brake ring connected to said lower end of said brake housing;

a brake ring carrier positioned in said housing at a distance above said lower brake ring;

said brake ring carrier having a central axis about which said brake ring carrier is rotatable;

said brake ring carrier axially slidable within said brake housing;

a spring positioned in said brake housing between said upper end and said brake ring carrier for biasing said brake ring carrier in a downward direction;

an upper brake ring connected to said brake ring carrier so as to face said lower brake ring;

a brake cartridge resting between said upper and said lower brake rings;

an abutment connected to said brake housing and extending radially into said brake housing;

said brake ring carrier having a plurality of support shoulders distributed over a periphery of said brake ring carrier, said support shoulders being axially spaced relative to one another, wherein, depending on a rotational position of said brake ring carrier, one of said support shoulders is supported on said abutment; and means for arresting said abutment at various positions in the axial direction of said brake housing.

2. A yarn brake according to claim 1, wherein said abutment is comprised of a cam and a rotary pin and said cam is eccentrically connected to said rotary pin; further including means for inserting said rotary pin into the tubular wall of said brake housing and means for actuating said rotary pin from the exterior of said brake housing.

3. A yarn brake according to claim 2, wherein said rotary pin has a circular cross-section and wherein said tubular wall of said rotary housing has a radial bore in which said rotary pin is rotatably supported.

4. A yarn brake according to claim 3, wherein said abutment has a circular cross-section.

* * * * *